US011828419B2

(12) United States Patent
Burkart et al.

(10) Patent No.: US 11,828,419 B2
(45) Date of Patent: Nov. 28, 2023

(54) HANDLE SPANNING TWO CYLINDERS

(71) Applicant: ICP Construction, Inc., Andover, MA (US)

(72) Inventors: Karl W. Burkart, Akron, OH (US); Christopher D. Dolezal, Canton, OH (US); Dujuan McClendon, Jr., Akron, OH (US)

(73) Assignee: ICP CONSTRUCTION, INC., Andover, MA (US)

( * ) Notice: Subject to any disclaimer, the term of this patent is extended or adjusted under 35 U.S.C. 154(b) by 0 days.

(21) Appl. No.: 17/158,419

(22) Filed: Jan. 26, 2021

(65) Prior Publication Data

US 2022/0235906 A1 Jul. 28, 2022

(51) Int. Cl.
*F17C 13/08* (2006.01)
*B65D 25/28* (2006.01)

(52) U.S. Cl.
CPC ..... *F17C 13/084* (2013.01); *B65D 25/2826* (2013.01); *F17C 2201/0104* (2013.01); *F17C 2205/013* (2013.01); *F17C 2205/0165* (2013.01); *F17C 2205/0305* (2013.01)

(58) Field of Classification Search
CPC ..... F17C 13/084; F17C 2201/0104; F17C 2205/013; F17C 2205/0165; F17C 2205/0305; F17C 2205/0157; F17C 2205/0188; B65D 25/2826; B65D 67/02; B65D 71/02; B65D 63/10; B65D 63/1018; B65D 63/1027; A45F 5/10
USPC ..... 220/759, 751, 754, 770
See application file for complete search history.

(56) References Cited

U.S. PATENT DOCUMENTS

| | | | | |
|---|---|---|---|---|
| 3,546,750 | A * | 12/1970 | Sheehan | B65D 63/1027 24/518 |
| 6,347,822 | B1 * | 2/2002 | Miller, Jr. | A45F 5/1026 294/166 |
| 7,021,500 | B1 * | 4/2006 | Finn | B29B 7/7433 222/145.5 |
| 2001/0001985 | A1 | 5/2001 | Hurray | |
| 2003/0085241 | A1 | 5/2003 | Brown | |
| 2004/0099695 | A1 | 5/2004 | Finn | |
| 2012/0085774 | A1 * | 4/2012 | Luburic | B65D 25/32 220/754 |
| 2013/0068718 | A1 * | 3/2013 | Tai | B65D 71/02 215/396 |

(Continued)

FOREIGN PATENT DOCUMENTS

| | | | |
|---|---|---|---|
| CA | 2194102 | A1 * | 6/1998 |
| EP | 0786753 | A2 * | 7/1997 |

OTHER PUBLICATIONS

Printout of Amazon product entitled "Kensington Protective Products Horse Tie," first available Mar. 13, 2014, retrieved from https://www.amazon.com/Safe-T-Tie-Horse-Tie-Revolutionary-Release/dp/B0174IX9K8 (Year: 2014).*

*Primary Examiner* — John K Fristoe, Jr.
*Assistant Examiner* — Laura E. Parker
(74) *Attorney, Agent, or Firm* — Fredrikson & Byron, P.A.

(57) ABSTRACT

The invention pertains generally to a handle which spans across two cylinders, each cylinder having a pair of collars, in which mating engagement is secured by various fastening approaches employing the peripheral ends of each handle.

3 Claims, 15 Drawing Sheets

(56) References Cited

U.S. PATENT DOCUMENTS

| | | | | |
|---|---|---|---|---|
| 2013/0087525 | A1* | 4/2013 | Tai | B65D 71/50<br>215/396 |
| 2013/0241224 | A1* | 9/2013 | Boland | A45F 5/102<br>294/158 |

* cited by examiner

HANDLE SPANNING TWO CYLINDERS

CROSS-REFERENCE TO RELATED APPLICATIONS

None.

TECHNICAL FIELD

The invention described herein pertains generally to a removable handle which spans the collars of two cylinders, preferably cylinders are non-refillable refrigerant disposal cylinders. The cylinders typically have diameters of 7½", 9", or 9½", often weighing approximately 30-70 pounds when filled.

BACKGROUND OF THE INVENTION

The invention relates to an improved detachable handle which spans the adjacent collars of two cylinders used to carry pressurized cylinders which house "A" isocyanate reactants and "B" polyol/catalyst/flame retardants/surfactants. Each cylinder is pressurized with a combination of inert gas(es)/propellants to achieve a gauge pressure of between 130-250 psig. The propellants can be HC (hydrocarbon), HFC (hydrofluorocarbon), HFO (hydrofluoroolefin), etc. The desired gases are environmentally friendly, i.e., are low-ozone-depleting and The industry has long searched for an effective, economical way to allow end-users to life pairs of cylinders and has employed the arrangement illustrated in FIGS. 1-4. However, the Prior Art solution illustrated in FIG. 1 often required metal fasteners, which are hard on the joints of a user's hand or required a combination of plastic parts as illustrated in FIGS. 2A, 2B, 3 & 4. These plastic connectors often came apart when lifting the cylinders.

What has been needed is a means by which the handle peripheral ends are matingly engaged with each other in a manner which is secure, safe and inexpensive to manufacture.

SUMMARY OF THE INVENTION

The present invention is directed to a handle which spans adjacent collars of two cylinders with collars.

What is shown in FIGS. 5-7 is a handle for spanning two adjacent cylinders, each cylinder having a pair of upwardly-extending collars having at least one aperture extending through a lower part of each collar, the handle further comprising: a middle segment with a first and a second peripheral arm at opposed ends of the middle segment; the first arm terminating with a male connector fitting; the second opposed arm terminating with a female connector fitting; and the first and second arms matingly engaging with each other after insertion of each arm through the at least one aperture in each collar by the male and female connector fittings. The handle will typically have a middle segment which is an expanded essentially oval or circular section; and wherein the middle segment has a plurality of vertical and upwardly-extending ribs from a longitudinal axis of the middle segment of the handle. In this aspect of the invention, the male connector fitting is at least one raised laterally-extending ridge; the female connector fitting is at least one laterally-extending opening for mating insertion of the male fitting laterally-extending ridge; and wherein mating engagement is by lateral engagement of the male and female connectors. The male connector fitting is at least two raised laterally-extending ridges; and the female connector fitting is at least two laterally-extending openings for mating insertion of the at least two male fitting laterally-extending ridges. In one embodiment, the at least one laterally-extending opening of the female connector is larger at one end than an opposed end; and mating insertion of the male fitting laterally-extending ridge is effected by one-way lateral insertion of the male connector into the larger opening of the female connector.

As better illustrated in FIG. 11, in another embodiment, the handle may have a male connector which is a projection having an expanded peripheral end and a narrower neck; and the female connector is a mating opening having a narrower exterior opening expanding to a larger interior opening; and wherein mating engagement is by lateral engagement of the male and female connectors.

As better illustrated in the embodiment illustrated in FIG. 12, the male connector is a projection having a terminal end and an expanded ramped section inward of the terminal end and a lip terminating the ramped section; the female connector is a mating opening with a raised section to match the ramped section of the male connector and an essentially oblique or parallel section essentially adjacent a plane of the lip of the male connector terminating the raised section; and mating engagement is by lateral engagement of the male and female connectors.

As shown in the embodiment of FIG. 13, the male connector is a button terminating a transverse shaft at a terminal end of the male connector; and the female connector is a mating hook at a terminal end of the female connector, the transverse shaft of the male connector dimensioned to fit inside an inner diameter of the mating hook of the female connector.

As shown in the embodiment of FIG. 14, the male connector is a split mirror-image half arrow at a terminal end of the male connector; and the female connector is a slot at a terminal end of the female connector dimensioned to permit insertion of the split mirror-image half arrow when the split half arrows are compressed in a sideways manner.

The embodiment of FIG. 16 illustrates the male connector is a button terminating a transverse shaft at a terminal end of the male connector; and the female connector has a pair of overlapping apertures along a longitudinal axis of the female connector and at a terminal end of the female connector, the distal aperture diametered to permit insertion of the button of the male connector therethrough and the proximal aperture diametered smaller than the distal aperture, but sufficiently large to permit the transverse shaft of the male connector button therethrough.

The embodiment of FIG. 17 shows the female connector being a yoke having coaligned lateral apertures at a terminal end; and the male connector is insertable into the yoke and having a lateral aperture at a terminal end of the male connector, said male connector aperture coaligning with the female connector apertures; and a retaining means comprising a shaft with an expanded button on one end of the shaft, the shaft dimensioned for insertion into the apertures of the female connector and the male connector when aligned.

The embodiment of FIG. 18 illustrates the male connector is a U-shaped segment having a pair of essentially parallel legs; the female connector is a split U-shaped segment having a pair of essentially parallel legs, the split occurring in one of the essentially parallel legs; and mating engagement is by insertion of the U-shaped male connector into the split U-shaped segment of the female connector.

FIG. 20 illustrates the male connector is an "X"-shaped connector affixed to a laterally-extending shaft; and the female connector is a mating "X"-shaped aperture, said female connector aperture offset from said male connector by approximately between 10° and 80° inclusive, preferably offset by approximately 45°.

FIG. 21 illustrates the female connector pair of generally opposed curvilinear slots with a terminal retention means, the female connector having an internal diameter; and the mating male connector has an outer diameter dimensioned to fit inside the internal diameter of the female connector, the male connector further having a mating projection dimensioned to fit within the opposed curvilinear slots.

FIG. 22 illustrates an embodiment wherein the female connector has an aperture at a peripheral end, the aperture containing a plurality of serrated receiving slots; the male connector has a peripherally extending projection having a plurality of serrations to matingly engage the serrated receiving slots.

FIG. 24 shows the male connector has a T-shaped projection at a peripheral end; and the female connector has a longitudinal axial slot dimensioned for insertion of the T-shaped projection.

FIG. 25 illustrates an embodiment wherein the male connector has a longitudinal axial extending projection at a peripheral end and at least one raised ridge positioned interiorly of the peripheral end of the male connector; and the female connector has a mating hole for insertion of the male connector projection, the hole having at least one circumferentially extending and a mating slot for engaging the at least one raised ridge.

FIG. 26 illustrates the male connector has a longitudinal axial extending projection at one end; and the female connector has a mating hole for insertion of the male connector projection, the female connector having a pair of parallel transverse slots which penetrate through the female connector and through at least a portion of the male connector projection; and a U-shaped locking means for insertion into the coaligned slots of the male and female connectors.

FIG. 27 shows an embodiment wherein the male connector is a hook; and the female connector is an aperture at one end of the female connector dimensioned for insertion of the hook.

FIG. 19 is exemplary of an embodiment where the male connector is a pair of mating straps with at least one notch on each lateral edge of the straps; and the second connector is a hollow rectangularly-shaped connector having a pair of lateral edges, and wherein each pair of lateral edges is at least partially inserted into each notch on each lateral edge of the pair of mating straps.

FIG. 23 is illustrative of an embodiment wherein the male connector is a pair of longitudinally axially extending projections having at least one raised ridge on each projection; and the female connector is a sleeve dimensioned for insertion onto the male connector projections, the sleeve having at least one inwardly-projecting slots for mating engagement with the at least one raised ridge.

FIG. 15 is an embodiment wherein the male and female connectors are a plurality of mating male projections and female receiving slots, the slots dimensioned to frictionally fit the male projections.

FIGS. 8-11 are an embodiment wherein a strap handle is illustrated for spanning two adjacent cylinders, each cylinder having a pair of upwardly-extending collars having at least one aperture extending through a lower part of each collar, the handle further comprising: a middle segment with a first and a second peripheral arm at opposed ends of the middle segment; the middle segment having a pair of mirror image triangular openings disposed therethrough; the first and second arms having an arrow-shaped peripheral end and a pair of inwardly-extending notches adjacent each arrow; each arrow-shaped peripheral end insertable into one of the pair of mirror image triangular openings; and securing engagement of the first and second peripheral arms effected by engagement of the inwardly-extending notches with the triangular opening.

FIGS. 28-30 are an embodiment wherein a strap handle is illustrated for a handle of for spanning two adjacent cylinders having a pair of upwardly-extending collars having at least one aperture extending through a lower part of each collar, the handle further comprising: a male connector that has a longitudinally axially extending protrusion followed by a recessed slot; and the female connector is a generally U-shaped receiver having a pair of parallel legs and a bottom connector connecting the pair of parallel legs, the generally U-shaped receiver positioned on top of a generally L-shaped component, wherein a bottom leg of the L-shaped component is positioned between an open side of the U-shaped receiver and a side leg of the L-shaped component is positioned underneath one of the parallel legs and extending into an opening created between the U-shaped receiver and L-shaped component, the opening dimensioned to permit removable attachment of the longitudinally axially extending protrusion therethrough, an underside of a proximal end of the protrusion positioned above an extending side of the side leg.

These and other objects of this invention will be evident when viewed in light of the drawings, detailed description and appended claims.

DETAILED DESCRIPTION OF THE INVENTION

The best mode for carrying out the invention will now be described for the purposes of illustrating the best mode known to the applicant at the time of the filing of this invention. The examples and figures are illustrative only and not meant to limit the invention, as measured by the scope and spirit of the claims.

Unless the context clearly indicates otherwise: the word "and" indicates the conjunctive; the word "or" indicates the disjunctive; when the article is phrased in the disjunctive, followed by the words "or both" or "combinations thereof" both the conjunctive and disjunctive are intended.

As used in this application, the term "approximately" is within 10% of the stated value, except where noted.

Figure 1:
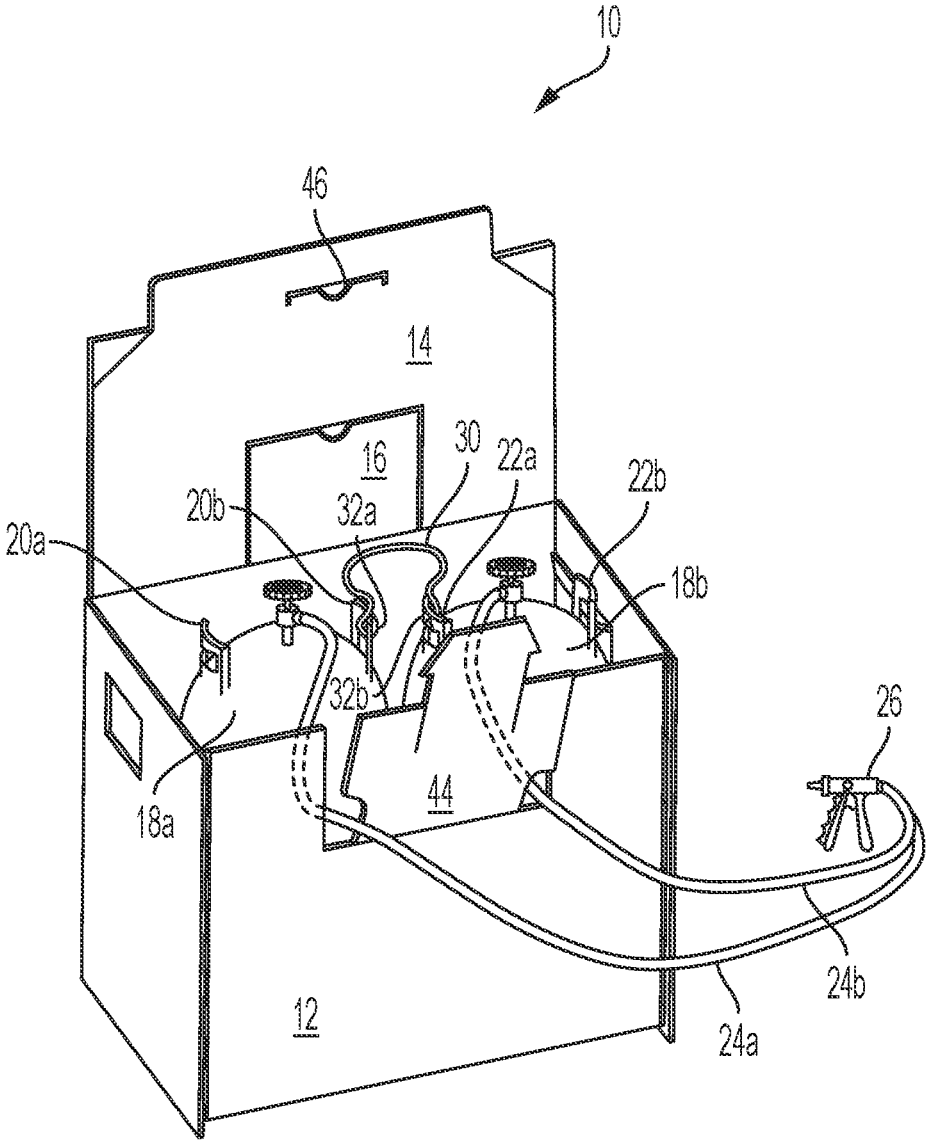
FIG. 1 PRIOR ART
FIG. 1 is a perspective view of two cylinders positioned within a box container having a Prior Art handle affixed to adjacent collars of each cylinder.
Figure 2A:
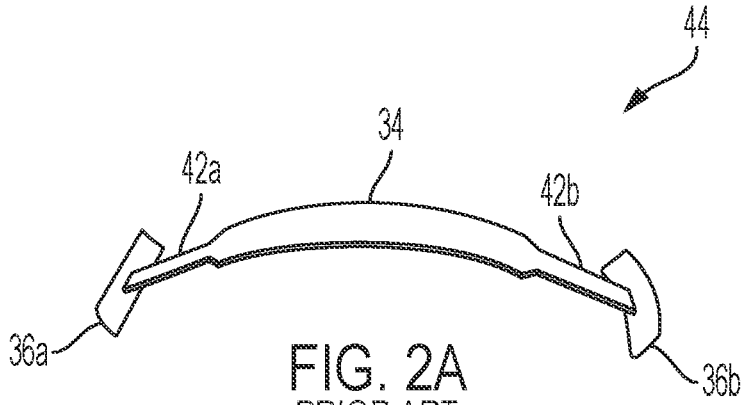
FIG. 2A PRIOR ART
FIG. 2A is a perspective view of a Prior Art top portion of a strap handle.
Figure 2B:
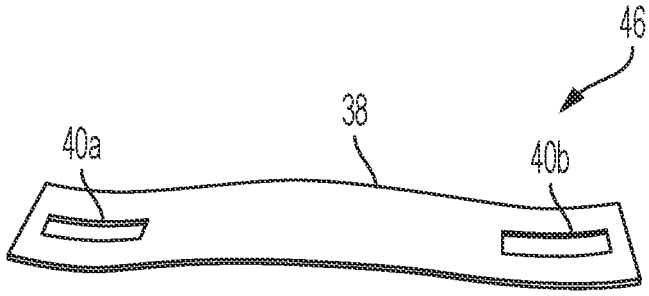
FIG. 2B PRIOR ART
FIG. 2B is a perspective view of a Prior Art bottom portion of a strap handle.
Figure 3:
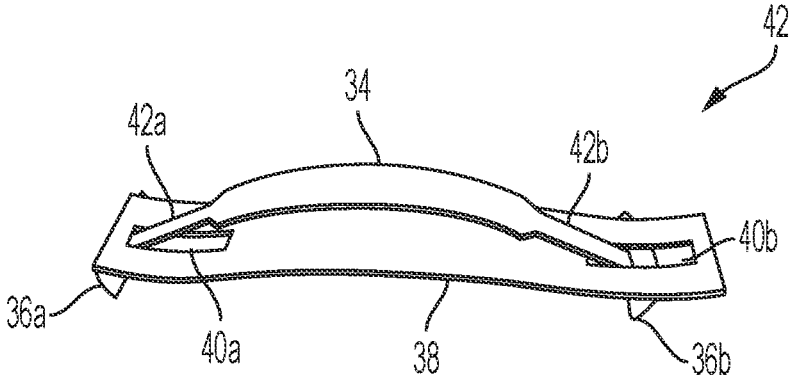
FIG. 3 PRIOR ART
FIG. 3 is a perspective view of a Prior Art strap handle illustrating the top and bottom strap portions combined.
Figure 4:
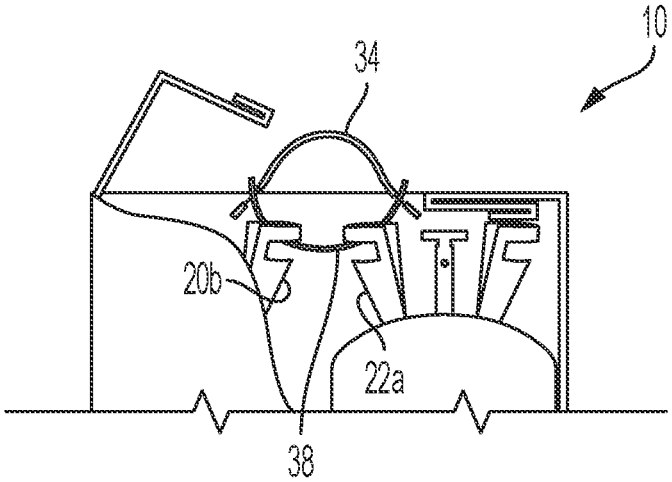
FIG. 4 PRIOR ART
FIG. 4 is a side elevational view in partial cut-away of a Prior Art strap handle of FIG. 3 shown connecting two cylinders.

FIG. 1 illustrates a Prior Art two-component foam carrying system 10 which uses two-cylinders 18*a*, 18*b* positioned within a carrying container, often constructed of cardboard or other pressed board. The container will have at least front side 12, a pair of lateral sides, a back and top flap 14. Pivotal flap 16 is often included for ease of access of carrying handle 30. Pivotable front flap portion 44 often includes a pair of egress openings for a pair of plastic hoses 24*a*, 24*b* and further often includes an arrowhead-shaped top portion for insertion into slot 46 positioned within top flap 14. Positioned toward a crown dome of each cylinder are a pair of collars 20*a*, 20*b* on cylinder 18*a* and collars 22*a*, 22*b* on cylinder 18*b*. Each cylinder has a metering valve positioned at an apex of the crown of the cylinder with a respective hose 24*a*, 24*b* leading to spray gun 26. Metal strap 30 is affixed by a pair of hooks 32*a*, 32*b* which are located at the extremities of metal strap 30. The hooks are typically "J-shaped" so as to be able to be affixed to the adjacent collars 20*b* and 22*a* as illustrated in the Figure.

In an alternative Prior Art configuration, plastic strap 42 is substituted for metal strap 30 as better illustrated in FIGS. 2A, 2B, 3 and 4. Plastic strap 42 typically will have top half portion 44 and bottom half portion 46. Top half portion 44 will have a thickened middle portion 34 and narrowed end portions 42*a*, 42*b*, each terminating with an expanded laterally-extending tab 36*a*, 36*b* respectively. Bottom half portion 46 is generally rectangular with a pair of opposed slots 20*a*, 20*b*. As better illustrated in FIG. 3, in combination, top 44 and bottom 46 portions are affixed together by insertion of laterally-extending tab 36*a* being inserted using a twisting motion into slot 42*a* with similar insertion of laterally-extending tab 36*b* into slot 40*b*. In operation and better illustrated in FIG. 4, each peripheral end of bottom half portion 46 is inserted into the openings of each cylinder collar 20*b*, 22*a* prior to insertion of top half portion 44 into the slots of bottom half portion 46.

Figure 5A:
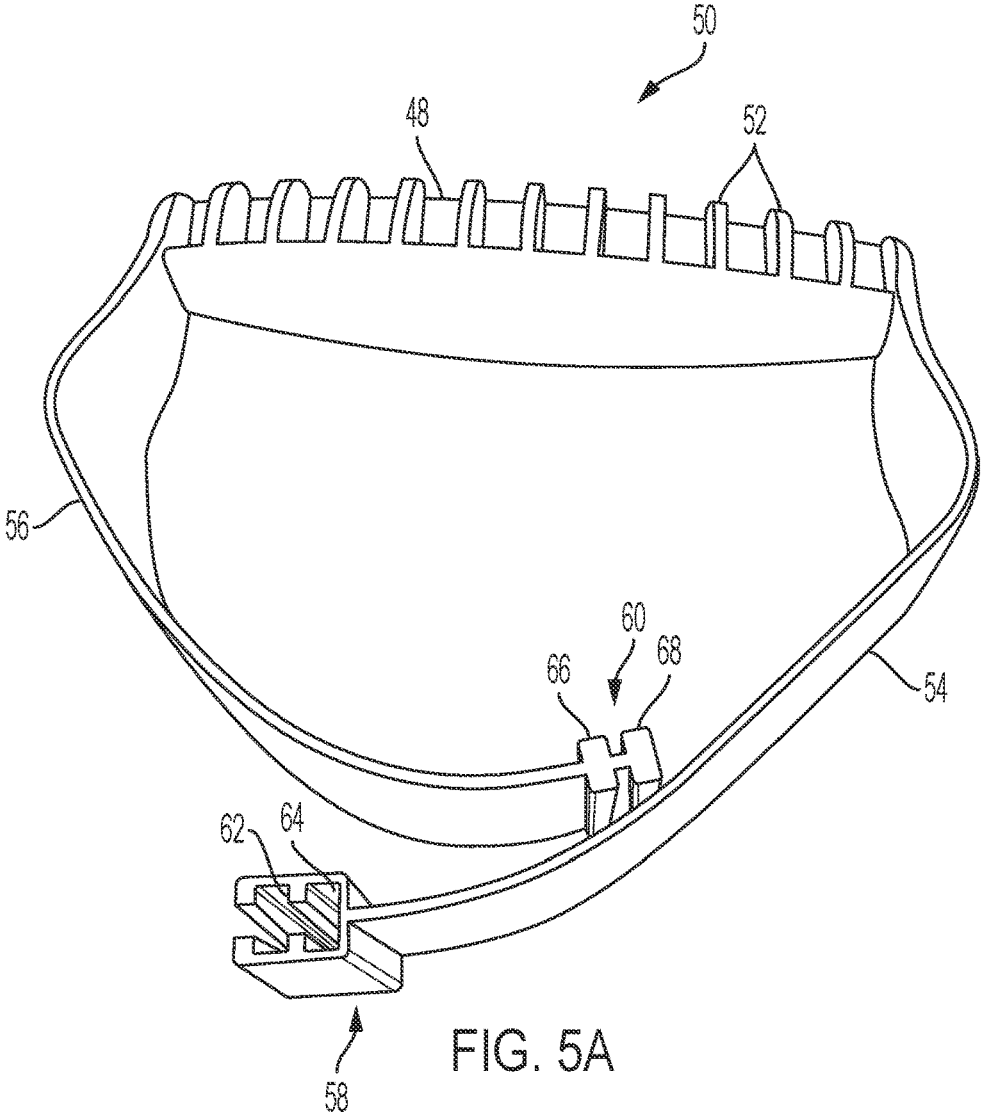
FIG. 5A is a perspective view of a handle and connecting means of the invention.
Figure 5B:
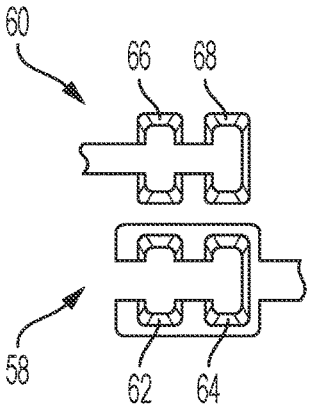
FIG. 5B is cross-sectional view of the connecting means shown in FIG. 5A in longitudinal cross-section in the embodiment where receiving channels 62, 64 at the proximal end of second leg 54 are of a larger width in contrast to the distal end, where they are narrower.
Figure 5C:
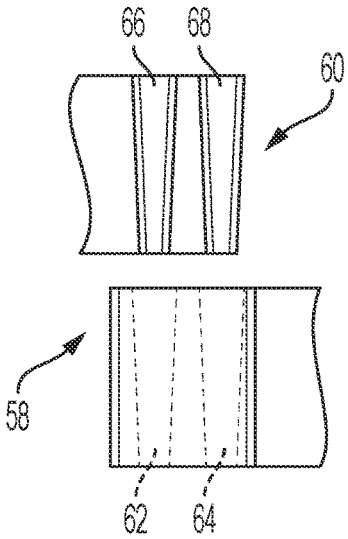
FIG. 5C is a cross-sectional view of the connecting means shown in FIG. 5B in axial cross-section.
Figure 5D:
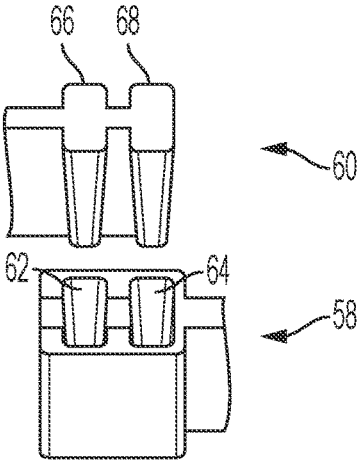
FIG. 5D is a perspective view of the connecting means shown in FIG. 5B.

The present invention improves on the Prior Art metal strap 30 or the flexible plastic strap 42 by recognizing that either of the Prior Art solutions are difficult for an end-user to hold for any extended period of time, recognizing that when the "A" and "B" cylinders are full of reactants, they can weigh approximately 90 pounds. As shown in FIGS. 5A, 5B, 5C, 5D and FIG. 6, handle 50 typically has a plurality of expanded reinforcing ribs 52 positioned on top portion 48 of the handle. On opposed ends of handle 50 are positioned downwardly-extending first leg 56 terminating with a male insertion connector 60 and second leg 54 terminating with a female receiving connector 58. In a preferred aspect of the invention, the laterally extending male insertion, 66, 68 and the mating female receiving channels 62, 64 are designed for insertion only in one direction. This is achieved by having the receiving channels 62, 64 at the proximal end of second leg 54 of a larger width in contrast to the distal end, where they are narrower. Typically, this is achieved in combination with the laterally extending male insertions 66, 68 being larger on the proximal end in contrast to the distal end. This ensures a snug fit when the male insertion and the female receiving channels are in mating engagement. FIG. 5B illustrates this concept in longitudinal cross-section; FIG. 5C illustrates this concept in axial cross-section; and FIG. 5D illustrates this concept in perspective.

Figure 6:
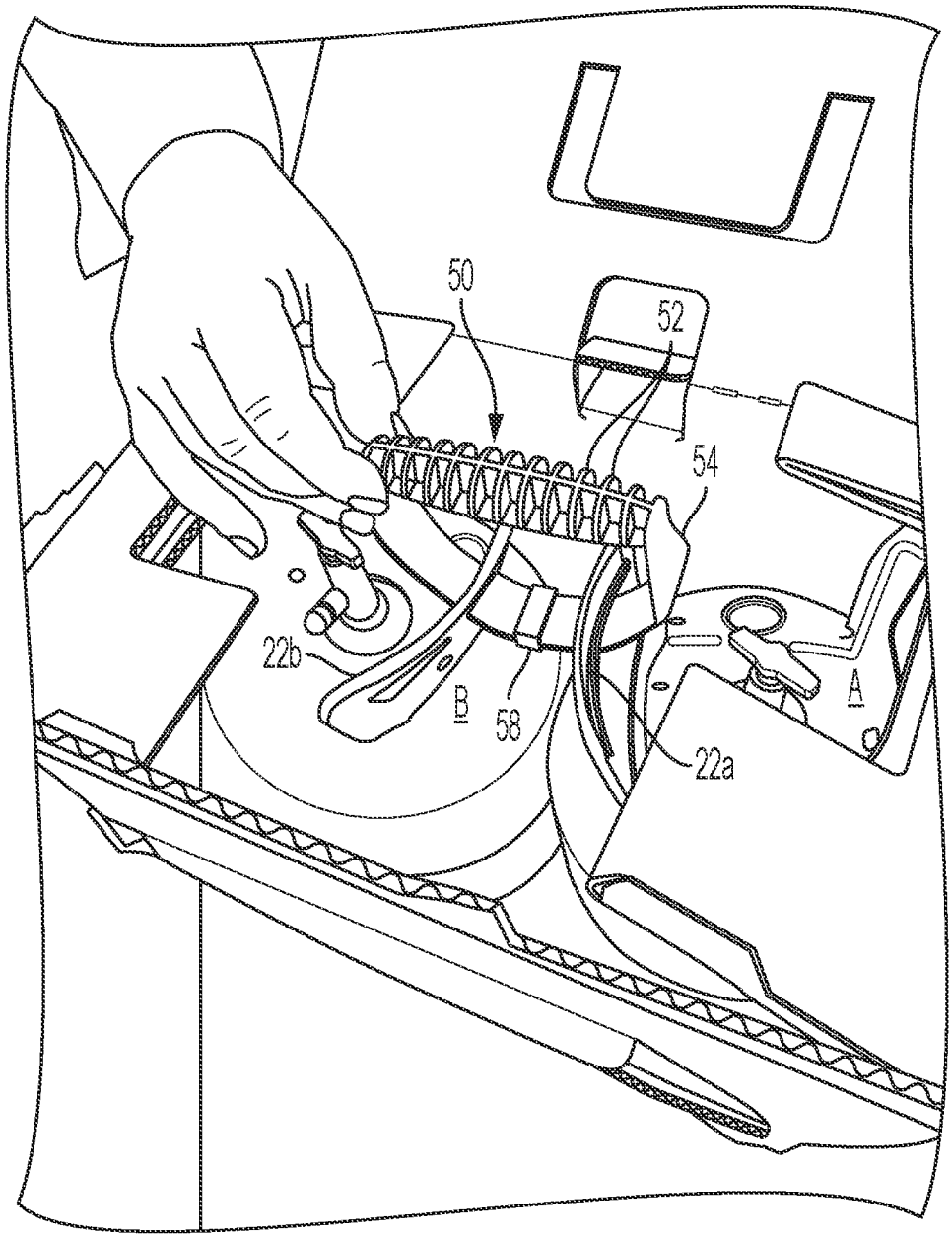
FIG. 6 is a perspective view of a handle and connecting means illustrating the handle connecting adjacent collars of the cylinders.
Figure 7:
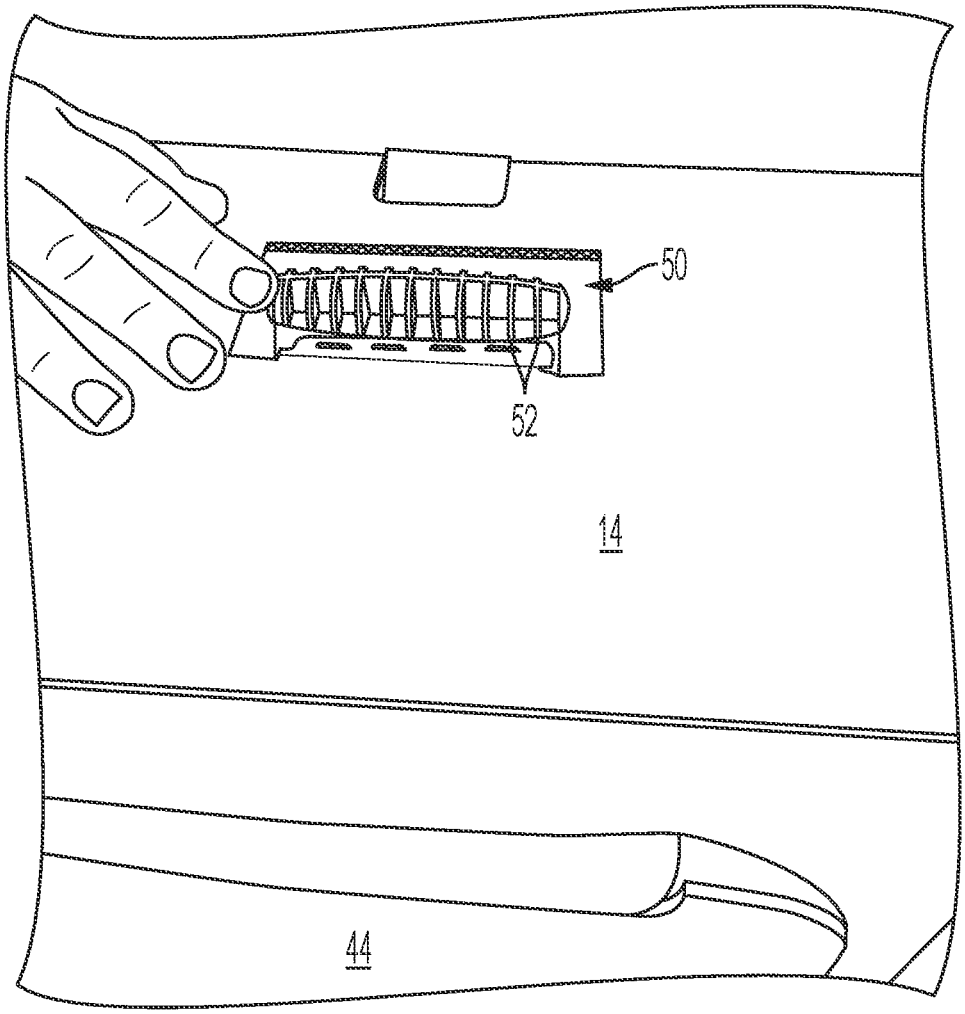
FIG. 7 is a perspective view of FIG. 6 illustrating the handle flush with a top flap of the box container.

As illustrated in FIG. 6, handle 50 is attached to cylinders "A" and "B" by threading each leg 54, 56 of the handle into the gap of adjacent cylinder collars 22*a*, 22*b* and inserting male insertion 60 into female receiver 58. FIG. 7 illustrates handle 50 essentially flush with top flap 14 thereby allowing stacking of containers. In each of FIGS. 6-7, it is noted that a user may access handle 50 when two cylinders are inside the box or container by a U-shaped slot in the upper lid of the box or container.

Figure 8:
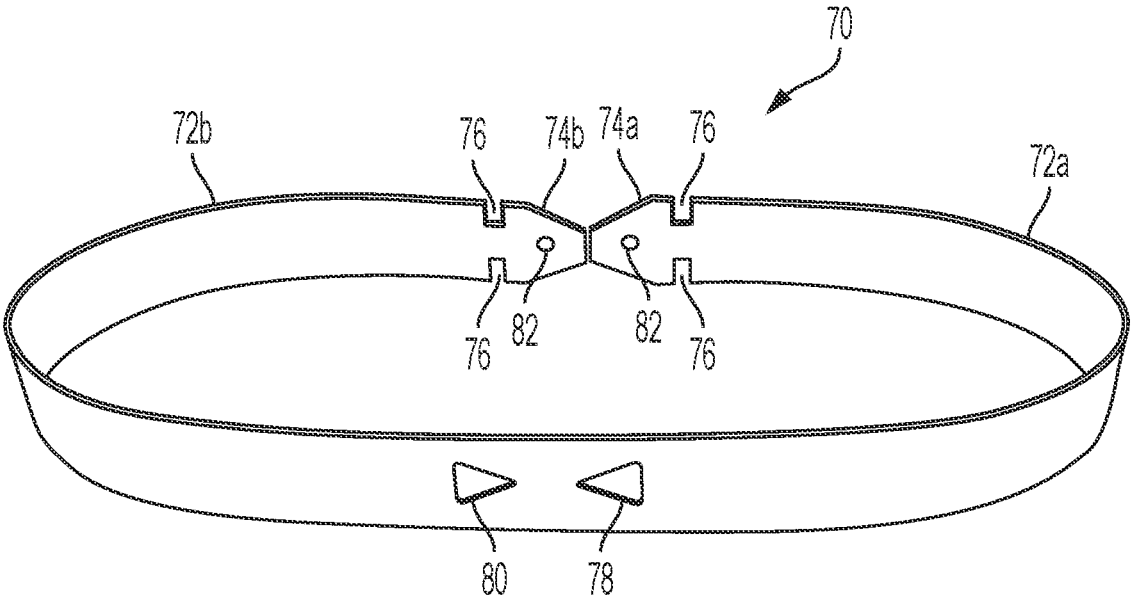
FIG. 8 is an alternative embodiment of a handle illustrating a different fastening means.
Figure 9:
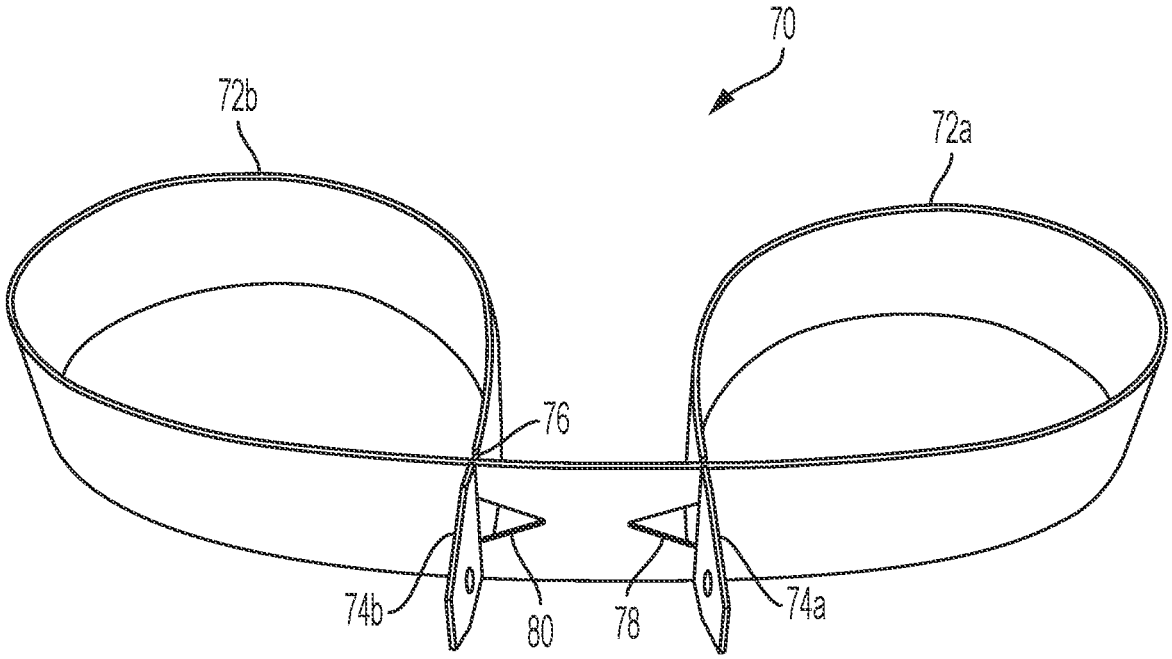
FIG. 9 is an illustration of the handle of FIG. 8 illustrating the fastening means being secured within the handle.
Figure 10:
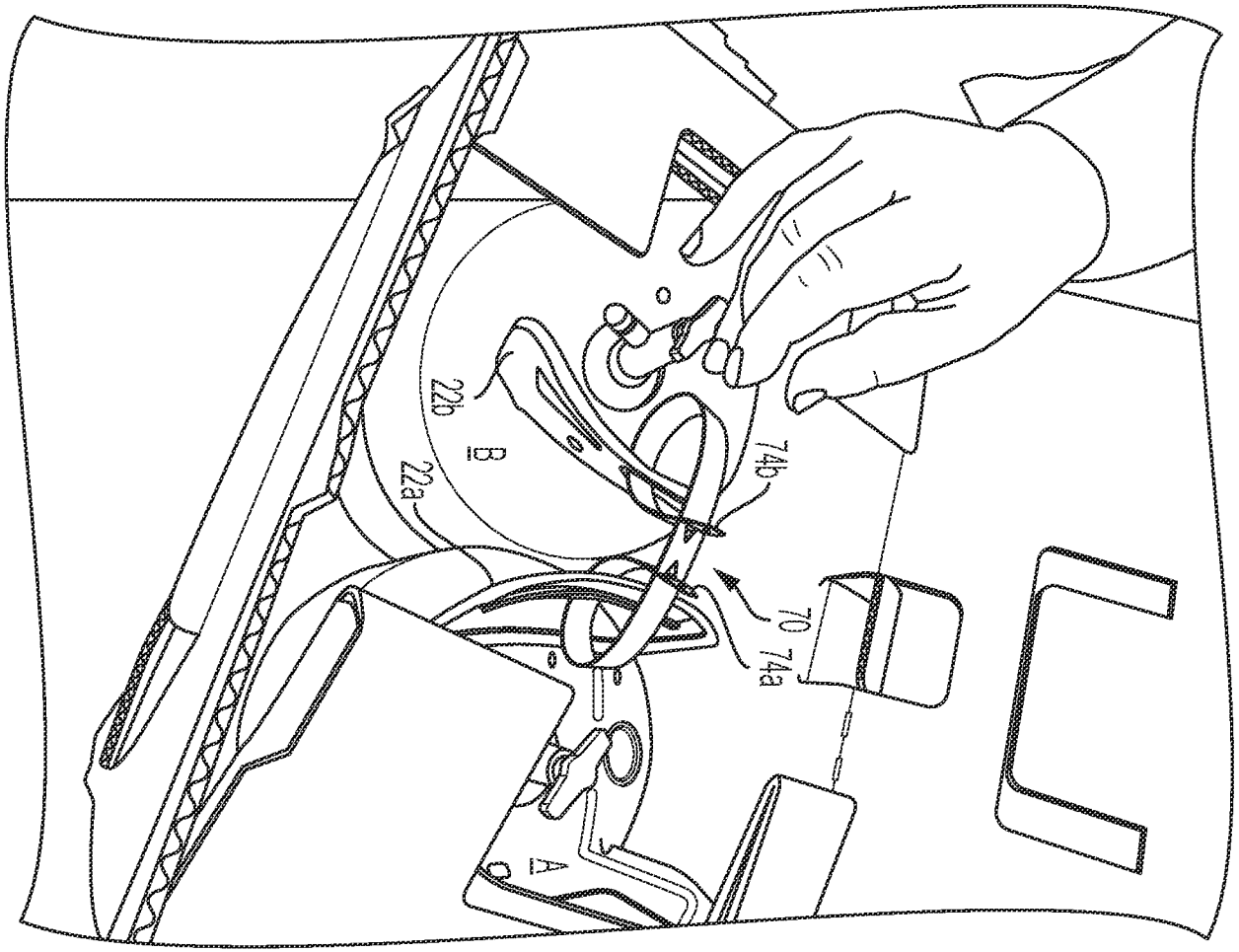
FIG. 10 is an illustration of the handle of FIG. 9 securing adjacent collars of cylinders.

As better illustrated in FIGS. 8-10, an alternative embodiment of the cylinder handle is illustrated. Hanger 70 is an elongated strap 72*a*, 72*b* terminating in a pair of arrowhead ends 74*a*, 74*b*. Each arrowhead end has a pair of opposed notches or indentations 76 adjacent the arrowhead ends and inward thereof. Each elongated strap 72*a*, 72*b* has a mirror image triangular opening positioned approximately midway along the length of the strap, the size of the openings dimensioned so as to permit insertion of either arrowhead end 74*a*, 74*b* with twisting so as to permit notches 76 to become snugly positioned within the triangular opening 78, 80 at each triangular base as better illustrated in FIG. 9. Securing hanger 70 is achieved by threading each end of the strap through collar openings 22*a*, 22*b* as better illustrated in FIG. 10 followed by insertion of each respective end 74*a*, 74*b* through mirror image triangular openings 78, 80.

Figure 11:
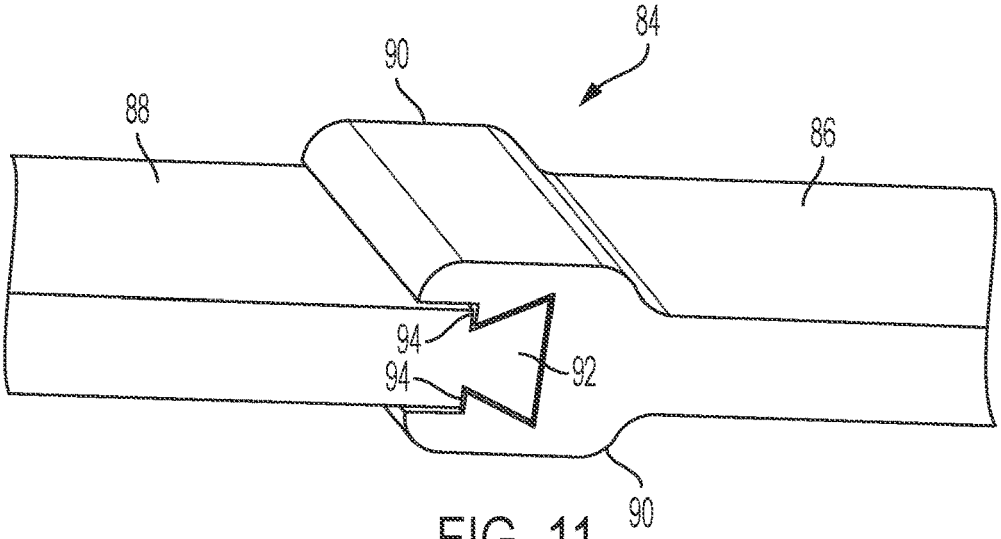
FIG. 11 is a partial perspective view of another embodiment of the fastening means in the handle.
Figure 12:
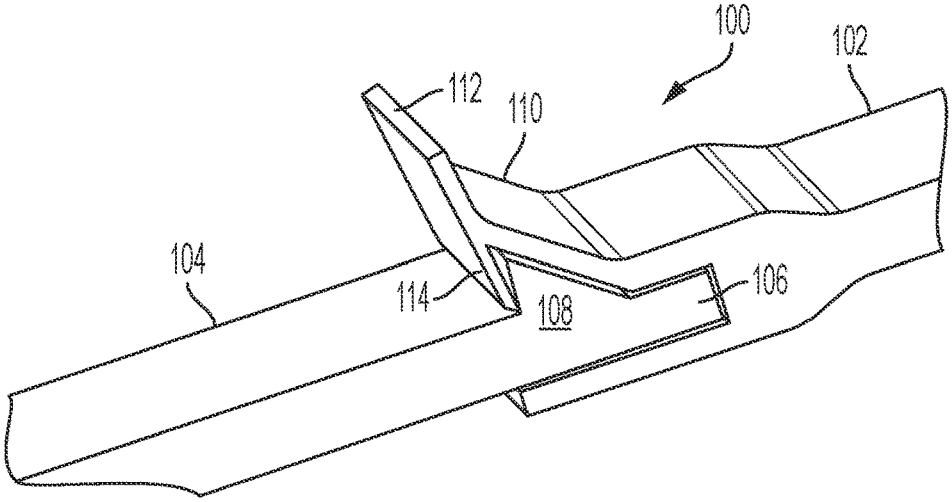
FIG. 12 is a partial perspective view of another embodiment of the fastening means in the handle.
Figure 13:
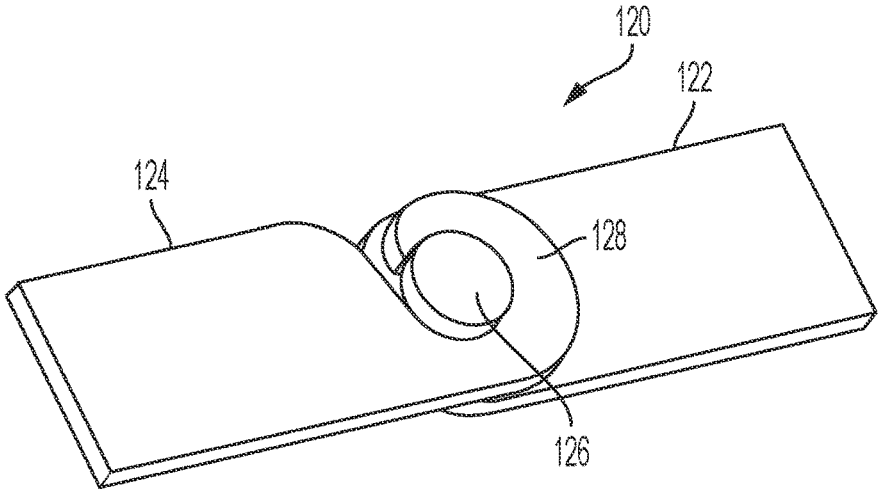
FIG. 13 is a partial perspective view of another embodiment of the fastening means in the handle.

The invention is not limited to the embodiments illustrated in FIGS. 5-10, but rather include additional attachment and fastening means. In FIG. 11, fastening means 84 includes mating segments on first and second strap ends 86, 88. Strap end 86 includes an expended terminal segment 90 having a geometric-shaped hollow female segment (illustrated as trapezoid shaped in the Figure) in mating engagement with a male projection 92 as illustrated. Penetrating male projection 92 has shelf or ledge 94 positioned at a narrowed segment of second strap end 88. FIG. 12 illustrates yet another attachment and fastening means 100 which includes mating segments on first and second strap ends 102, 104. Female strap end 102 includes an expanded end 110 having essentially laterally-extending tip portions 112, 114. Strap end 104 includes a penetrating male portion 106 dimensioned to fit into the female strap end. Penetrating male portion 106 ramps post the distal end of second strap end 104 to frictionally engage laterally-extending tip portion 114 thereby forming a locking engagement. As illustrated in FIG. 12, another mating combination 120 is illustrated by having mating male button 126 positioned on one of legs 122, 124 with partially closed female receiver 128, illustrated as an incomplete "O"-shape in the figure. Depending on the degree of flexibility of the polymeric material that the straps are made from, female receiver 128 may be an enclosed circle into which mating male button 126 is pushed through.

Figure 14:
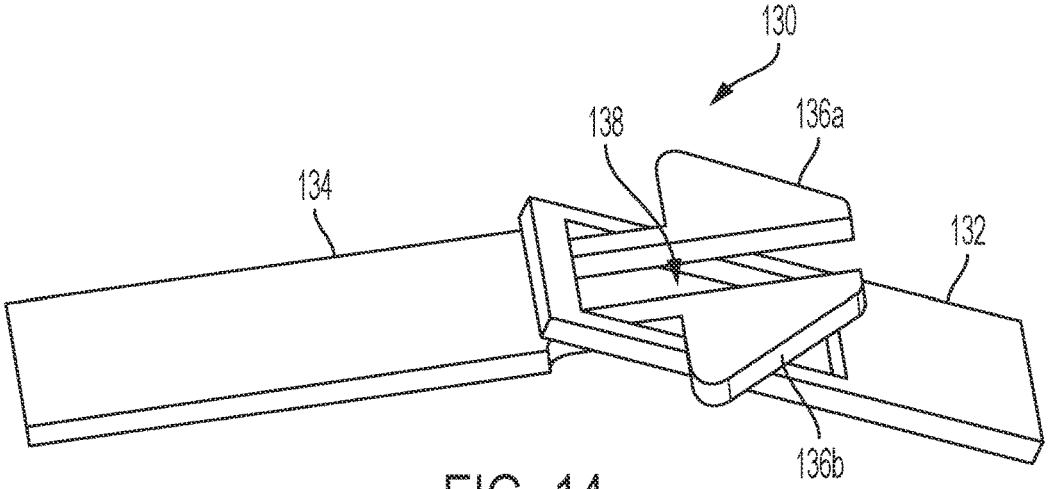
FIG. 14 is a partial perspective view of another embodiment of the fastening means in the handle.
Figure 15:
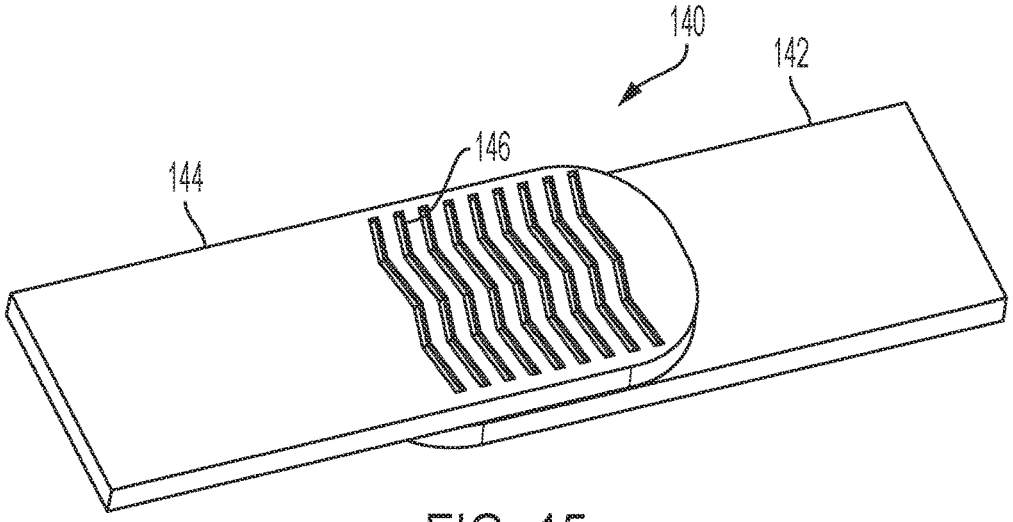
FIG. 15 is a partial perspective view of another embodiment of the fastening means in the handle.
Figure 16:
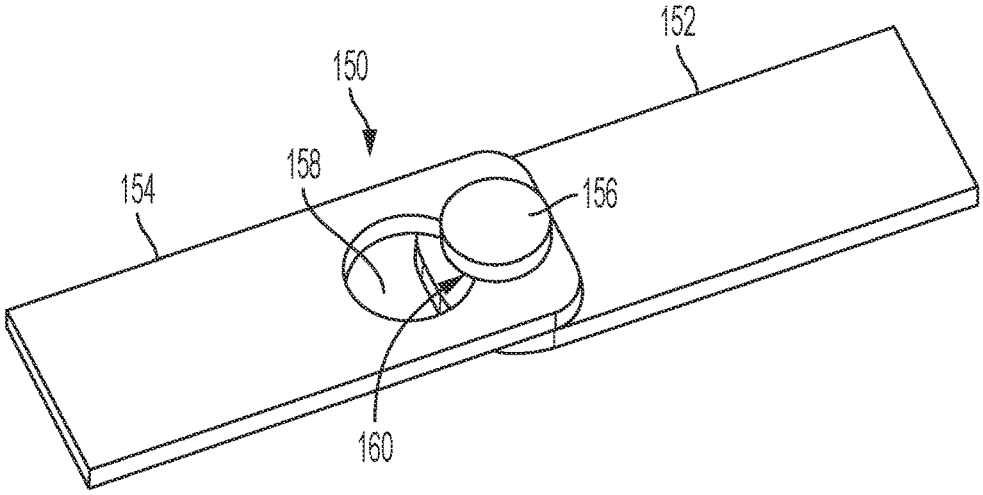
FIG. 16 is a partial perspective view of another embodiment of the fastening means in the handle.

In yet other embodiments and as illustrated in FIG. 14, closure means 130 of the pair of straps 132, 134 is affected by a pair of mirror-image split triangular shaped male insertion tabs 136*a*, 136*b* into an essentially rectangular opening 138. FIG. 15 illustrates yet another embodiment of effecting closure 140 between first and second strap ends 142, 144 by using a pair of mating depressions and raised ridges 146. In FIG. 16, closure means 150 for a pair of straps 152, 154 is a combination of a overlapping apertures 158, 160 on first strap 154 and an insertable button 156. First strap opening 158 is dimensioned so as to permit insertion of button 156 by its peripheral diameter whereas second strap opening 160 is dimensioned to be smaller than the first strap opening but still dimensioned so as to permit engagement about a diameter of a shaft which connects button 156 to second strap 152.

Figure 17:
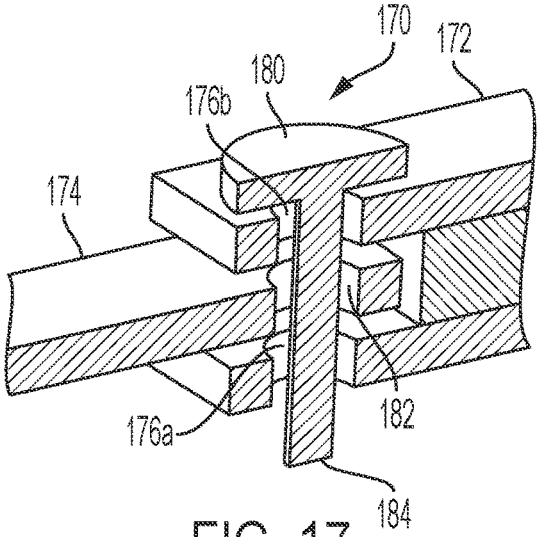
FIG. 17 is a partial cross-sectional view in perspective of another embodiment of the fastening means in the handle.
Figure 18:
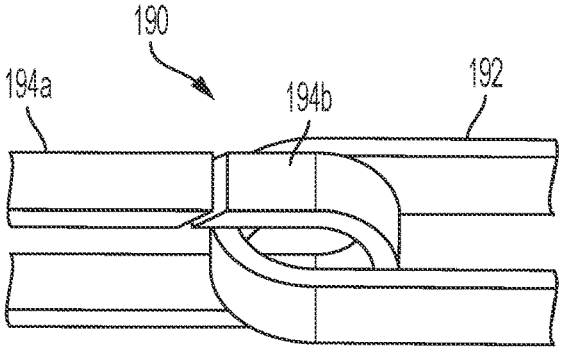
FIG. 18 is a partial perspective view of another embodiment of the fastening means in the handle.
Figure 19:
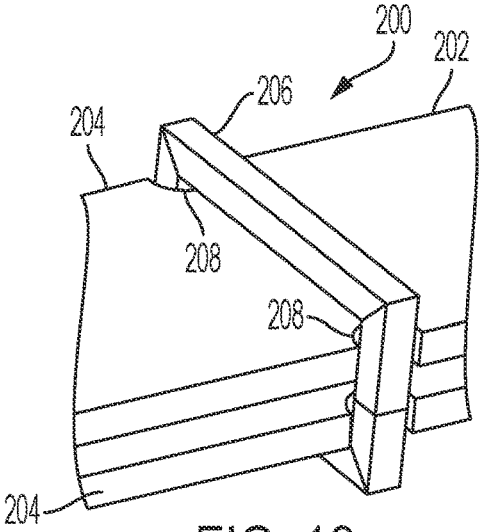
FIG. 19 is a partial perspective view of another embodiment of the fastening means in the handle.
Figure 20:
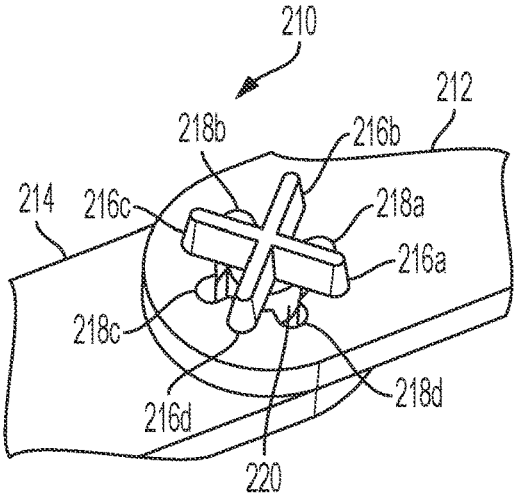
FIG. 20 is a partial perspective view of another embodiment of the fastening means in the handle.
Figure 21:
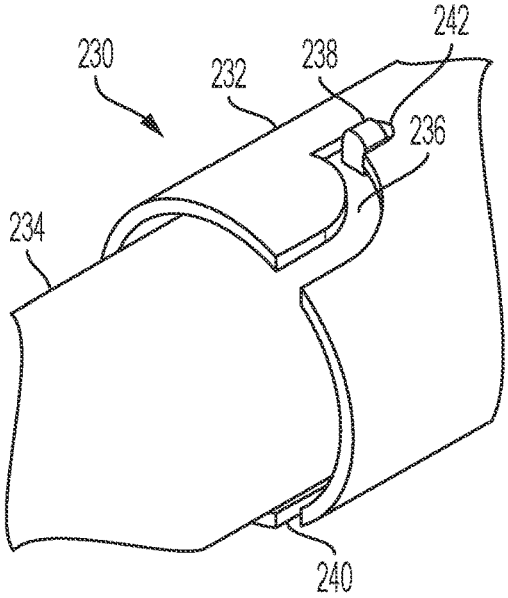
FIG. 21 is a partial perspective view of another embodiment of the fastening means in the handle.

FIG. 17 illustrates yet another approach to connecting a pair of straps. Closure means 170 for ends 172, 174 is a combination of a yoke-shaped end on strap 172 in combination with a mating insertion end on strap 174. When strap 174 is fully inserted into the yoke, apertures 176*a*, 176*b* and 182 align (recognizing that the Figure is in cross-section) thereby permitting insertion of shaft 184 upon which is affixed button-end 180 which is dimensioned to have a larger diameter than apertures 176*a*, 176*b* and 182. FIG. 18 illustrates an additional fastening means 190 for connecting a pair of straps, at least one of which is a split strap 194*a*, 194*b* and one illustrated as a non-split strap 192, recognizing that this second strap could also be split as illustrated with split strap 194*a*, 194*b*. As viewed in FIG. 19, a closure means 200 is illustrated for straps 202, 204. Each strap has a notched indentation 208 at a peripheral end and a rectangular-shaped fastening means 206 is positioned at the notches. Yet another variation of a closure means 210 is illustrated in FIG. 20 for straps 212, 214. Strap 214 has a plurality of cut-outs toward peripheral end of first strap 214 while the peripheral end of second strap 212 has a mating set of raised projections to match the plurality of cut-outs. Specifically, in the Figure, four cut-outs, 218*a*, 218*b*, 218*c*, 218*d* are dimensioned for mating insertion of four raised projections 216*a*, 216*b*, 216*c* and 216*d*. While the number illustrated is four, any number of mating cut-outs to raised projections greater than two would be sufficient to make a working connector. The raised projections and cut-outs are offset from each other by at least 10° and less than 80° inclusive. In a preferred configuration, the degree of offset is 45°. FIG. 21 illustrates yet another connector means 230 in which each strap is tubular 232, 234. The closure means 230 includes at least one curvilinear slot 236 in first tube 232 into which is inserted projection 238. Curvilinear slot 236 has at least one locking indentation 242 for securing the inserted smaller outer diametered tube 234 into the larger inner diametered tube 232. As illustrated in the figure, a second curvilinear slot 240 is illustrated with similar characteristics to that described for curvilinear slot 236.

Figure 22:
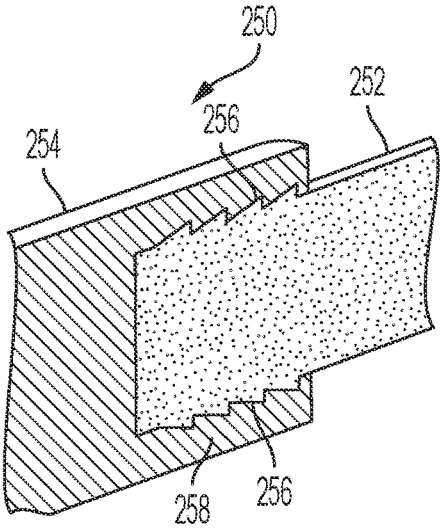
FIG. 22 is a cross-sectional view of another embodiment of the fastening means in the handle.
Figure 23:
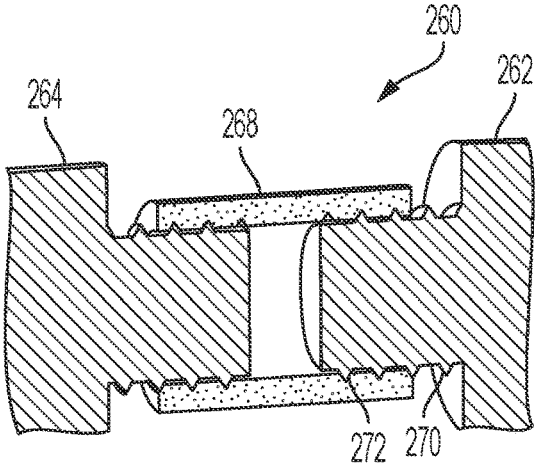
FIG. 23 is a cross-sectional view of another embodiment of the fastening means in the handle.
Figure 24:
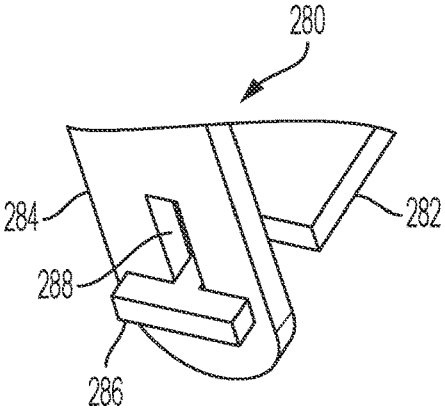
FIG. 24 is a partial perspective view of another embodiment of the fastening means in the handle.
Figure 25:
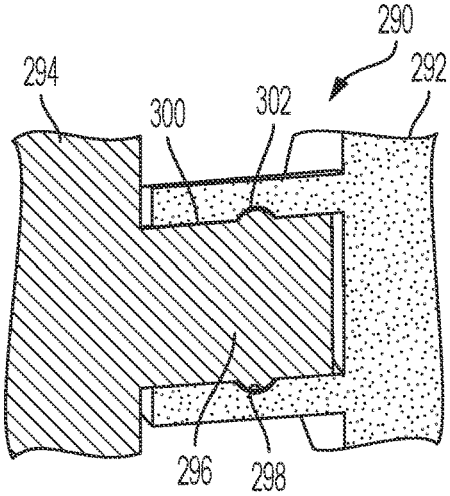
FIG. 25 is a cross-sectional view of another embodiment of the fastening means in the handle.

FIG. 22 illustrates yet another connector means 250 by which first strap 254 and second strap 252 are joined by a plurality of raised serrations 258 on an exterior surface which is inserted into a mating reverse serrated aperture 258 in first strap 254 adjacent a peripheral end thereof. FIG. 23 illustrates another connector means 260 which connects first and second tubular straps 262, 264 by interfacing a plurality of raised ridges 270 with a plurality of mating indentations 272 on sleeve 268. FIG. 24 illustrates a further embodiment of connector 280 in which straps 282, 284 are joined. First strap 282 has a "T-shaped" distal end 286 which is inserted into slot 288 on second strap 284. Still another connector means 290 is illustrated in FIG. 25. Tubular straps 292, 294 are affixed together by inserting projection 296 into mating aperture 300. Projection 296 has a projecting annular ring 298 about a periphery for mating engagement with an inwardly extending indentation 302. In one embodiment, the outwardly extending annular ring is discontinuous having at least one raised projection for mating engagement with at least one inwardly extending indentation.

Figure 26A:
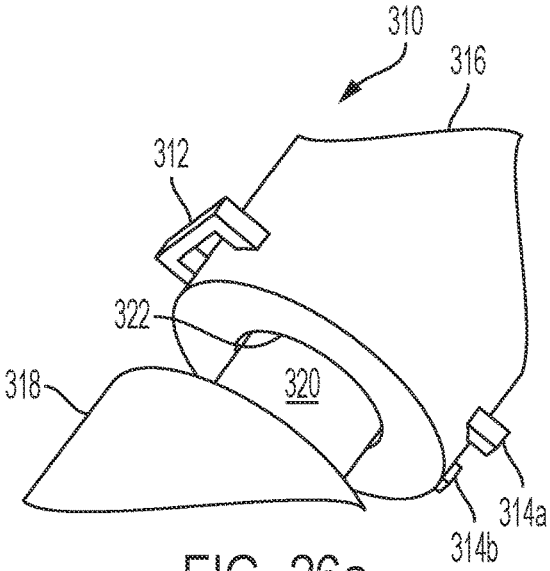
FIG. 26*a* is a partial perspective view of another embodiment of the fastening means in the handle.
Figure 26B:
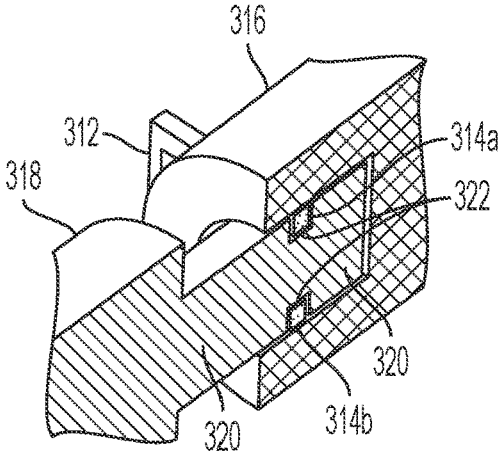
FIG. 26*b* is a partial perspective view in partial cross-section of another embodiment of the fastening means in the handle.
Figure 27:
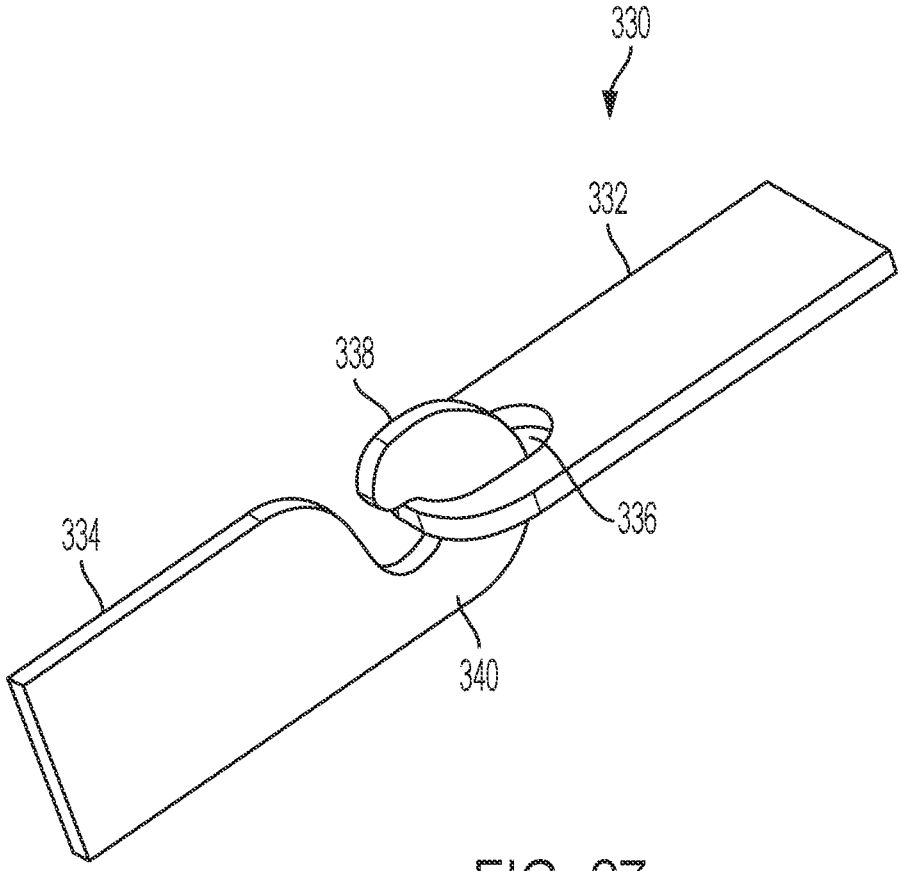
FIG. 27 is a partial perspective view of another embodiment of the fastening means in the handle.

FIGS. 26*a* & 26*b* yet another fastening means 310 in which tubular connectors 316, 318 are securedly jointed by the insertion of male projection 320 into mating female receiver 322 into which the male projection is inserted. The fastening is secured by insertion of a pair of parallel legs 314*a*, 314*b* of U-shaped bar 312 into a mating pair of apertures 322 in tubular connector 316 as well as male projection 320. FIG. 27 illustrates a further fastening means 330 in which straps 332, 334 are connected by engagement of a projecting hook 340 having at least a partial opening on one side with mating aperture 336 on strap 332.

Figure 28:
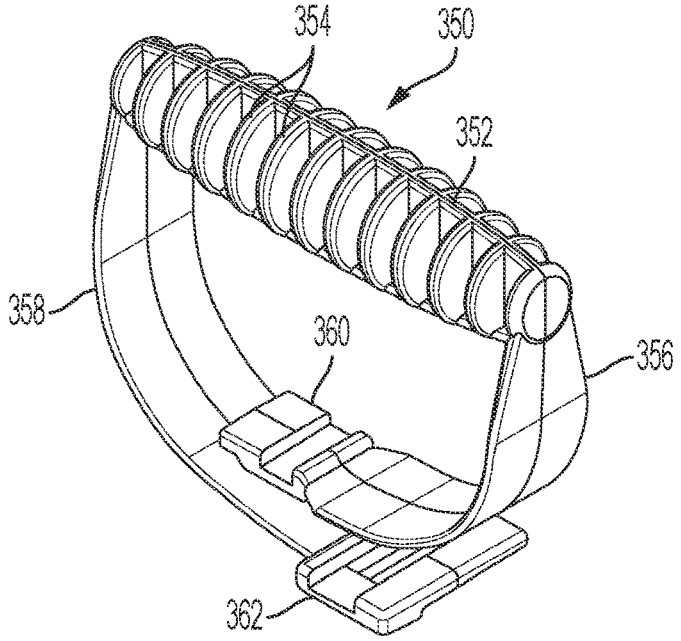
FIG. 28 is a perspective view of another embodiment of the male/female fastening means for the handle.
Figure 29:
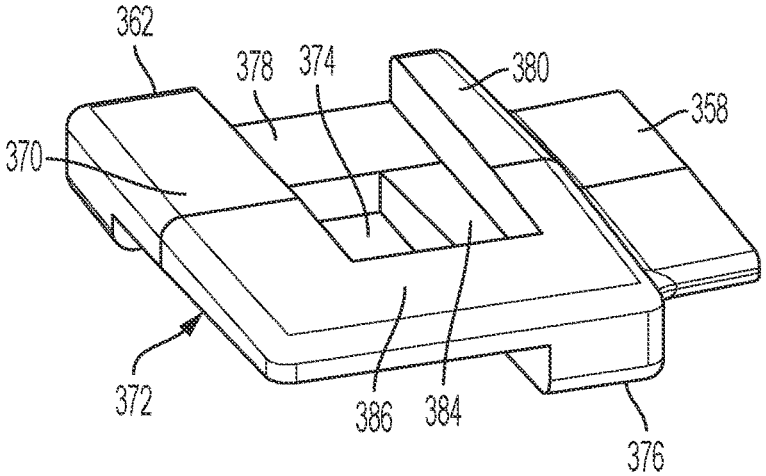
FIG. 29 is an exploded view in partial perspective illustrating the female attachment component of FIG. 28.
Figure 30:
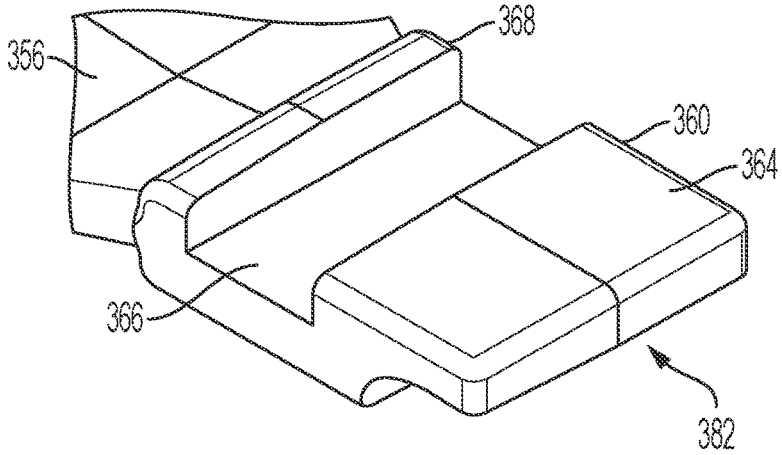
FIG. 30 is an exploded view in partial perspective illustrating the male attachment component of FIG. 28.

FIGS. 28-30 illustrate yet another fastening means 350 in which a pair of arms 358, 356 are securedly and releasably fastened by insertion of male clasp 360 into female clasp 362. In a manner like that shown in FIGS. 5-7, handle 350 has a plurality of expanded reinforcing ribs 352 positioned on top portion 354 of the handle. Securing attachment is affected by mating releasable engagement of clasps 360, 362. As better illustrated in FIG. 29, female clasp 362 is secured to arm 356 typically by plastic molding processing, although other means of attachment are within the scope of this invention, namely gluing or friction fit or one-way insertion. The female clasp end is comprised of a U-shaped connector having a pair of parallel legs 370, 380 connected by bottom 386. Within an opening created within the U-shaped connector, is a lowered L-shaped component which protrudes below leg 380 and underneath leg 370 connected by bottom leg 378. The combination of legs 384, 378 of the L-shaped component in combination with bottom 386 and leg 370 of the U-shaped connector is open slot 374. As illustrated in FIG. 30, male clasp 360 is dimensioned to fit into opening 374 of female clasp 362. When the male clasp is inserted into the female clasp, underside 382 of male projection 364 is positioned to rest on upwardly protruding leg 384 of the L-shaped component and slot 366 is positioned to rest on a bottom 372 of leg 370 with raised projection 368 securing the attachment of the slotted area by a friction fit.

While the above discussion has been generally directed toward embodiments in which the two cylinders are contained within a cardboard box enclosure, there is no need to limit the scope of this invention to such. In fact, in one preferred aspect, the handle and various connection means could be used in any situation where a cylinder having at least one upwardly-extending collar on each of the cylinders is being employed and wherein it is desirable to connect the collars for ease of transport.

As stated in the previous paragraph, it is noted that these handles are not limited to a single use application. After the handle has been used in a cardboard box enclosure, the handles are designed to be re-used, whether that re-use is for the originally intended purpose or for a different purpose. It is the refastenable aspect illustrated in FIGS. 5-30 that allow an end-user to repurpose the handle, or to re-use the handle a second time for the original purpose. Any application in which one strap portion of the handle can be inserted into an aperture (whether that aperture is a cylinder collar or some other aperture) is applicable to the instant invention. And there is no need for two apertures in adjacent cylinders for this second reusable embodiment of the invention. If desired by the end-user, the second use can be chosen to employ only one aperture into which the handle is inserted. In this application, the device having but one aperture, can more easily be transported with less stress concentrated on an end-user's finger joints by for example using the handle having a thicker middle segment, which spreads the downward forces about a larger surface area of the end-user's finger joints.

The handle is typically made of a polymer, either a thermoplastic or a thermoset and depending on the application, a thermoplastic elastomer. Low cost is often a factor in the composition of the polymer as the item is often, but not always, a throw-away item. An illustrative non-limiting set of examples of polymers which may be used in the molding of the handle include, but are not limited to:

Polymers of monoolefins and diolefins for example polypropylene, polyisobutylene, polybut-1-ene, poly-4-methylpent-1-ene, polyvinylcyclohexane, polyisoprene or polybutadiene, as well as polymers of cycloolefins, for instance of cyclopentene or norbornene, polyethylene (which optionally can be crosslinked), for example high density polyethylene (HDPE), high density and high molecular weight polyethylene (HDPE-HMW), high density and ultrahigh molecular weight polyethylene (HDPE-UHMW), medium density polyethylene (MDPE), low density polyethylene (LDPE), linear low density polyethylene (LLDPE), (VLDPE) and (ULDPE), and blends of the polymers described above, regardless of the method of preparation. Mixtures of the polymers above are also included, for example, mixtures of polypropylene with polyisobutylene, polypropylene with polyethylene (for example PP/HDPE, PP/LDPE) and mixtures of different types of polyethylene (for example LDPE/HDPE). Copolymers of monoolefins and diolefins with each other or with other vinyl monomers such as ethylene/propylene copolymers, linear low density polyethylene (LLDPE) and mixtures thereof with low density polyethylene (LDPE), propylene/but-1-ene copolymers, propylene/isobutylene copolymers, ethylene/but-1-ene copolymers, ethylene/hexene copolymers, ethylene/methylpentene copolymers, ethylene/heptene copolymers, ethylene/octene copolymers, ethylene/vinylcyclohexane copolymers, ethylene/cycloolefin copolymers (e.g. ethylene/norbornene like COC), ethylene/1-olefins copolymers, where the 1-olefin is generated in-situ; propylene/butadiene copolymers, isobutylene/isoprene copolymers, ethylene/vinylcyclohexene copolymers, ethylene/alkyl acrylate copolymers, ethylene/alkyl methacrylate copolymers, ethylene/vinyl acetate copolymers or ethylene/acrylic acid copolymers and their salts (ionomers) as well as terpolymers of ethylene with propylene and a diene such as hexadiene, dicyclopentadiene or ethylidene-norbornene; and mixtures of such copolymers with one another and with polymers mentioned previously, for example polypropylene/ethylene-propylene copolymers, LDPE/ethylene-vinyl acetate copolymers (EVA), LDPE/ethylene-acrylic acid copolymers (EAA), LLDPE/EVA, LLDPE/EAA and alternating or random polyalkylene/carbon monoxide copolymers and mixtures thereof with other polymers, for example polyamides.

Polystyrene and poly(p-methylstyrene) and poly(α-methylstyene). Aromatic homopolymers and copolymers derived from vinyl aromatic monomers including styrene, α-methylstyrene, all isomers of vinyl toluene, especially p-vinyltoluene, all isomers of ethyl styrene, propyl styrene, vinyl biphenyl, vinyl naphthalene, and vinyl anthracene, and mixtures thereof. Homopolymers and copolymers may have any stereostructure including syndiotactic, isotactic, hemi-isotactic or atactic. Stereoblock polymers are also included. Copolymers are included, such as vinyl aromatic monomers and comonomers selected from ethylene, propylene, dienes, nitriles, acids, maleic anhydrides, maleimides, vinyl acetate and vinyl chloride or acrylic derivatives and mixtures thereof, for example styrene/butadiene, styrene/acrylonitrile, styrene/ethylene (interpolymers), styrene/alkyl methacrylate, styrene/butadiene/alkyl acrylate, styrene/butadiene/alkyl methacrylate, styrene/maleic anhydride, styrene/acrylonitrile/methyl acrylate; mixtures of high impact strength of styrene copolymers and another polymer, for example a polyacrylate, a diene polymer or an ethylene/propylene/diene terpolymer; and block copolymers of styrene such as styrene/butadiene/styrene, styrene/isoprene/styrene, styrene/ethylene/butylene/styrene or styrene/ethylene/propylene/styrene. Hydrogenated aromatic polymers derived from hydrogenation of polymers mentioned above are included, especially including polycyclohexylethylene (PCHE) prepared by hydrogenating atactic polystyrene, often referred to as polyvinylcyclohexane (PVCH). Further included are hydrogenated aromatic polymers derived from hydrogenation of polymers mentioned previously. The homopolymers and copolymers may have any stereostructure including syndiotactic, isotactic, hemi-isotactic or atactic. Stereoblock polymers are also included. Graft copolymers of vinyl aromatic monomers, such as styrene or α-methylstyrene, for example styrene on polybutadiene, styrene on polybutadiene-styrene or polybutadiene-acrylonitrile copolymers; styrene and acrylonitrile (or methacrylonitrile) on polybutadiene; styrene, acrylonitrile and methyl methacrylate on polybutadiene; styrene and maleic anhydride on polybutadiene; styrene, acrylonitrile and maleic anhydride or maleimide on polybutadiene; styrene and maleimide on polybutadiene; styrene and alkyl acrylates or methacrylates on polybutadiene; styrene and acrylonitrile on ethylene/propylene/diene terpolymers; styrene and acrylonitrile on polyalkyl acrylates or polyalkyl methacrylates, styrene and acrylonitrile on acrylate/butadiene copolymers, as well as mixtures thereof with the copolymers listed above, for example the copolymer mixtures known as ABS, MBS, ASA or AES polymers.

Halogen-containing polymers such as polychloroprene, chlorinated rubbers, chlorinated and brominated copolymer of isobutylene-isoprene (halobutyl rubber), chlorinated or sulfo-chlorinated polyethylene, copolymers of ethylene and chlorinated ethylene, epichlorohydrin homo- and copolymers, especially polymers of halogen-containing vinyl compounds, for example polyvinyl chloride, polyvinylidene chloride, polyvinyl fluoride, polyvinylidene fluoride, as well as copolymers thereof such as vinyl chloride/vinylidene chloride, vinyl chloride/vinyl acetate or vinylidene chloride/vinyl acetate copolymers. such as styrene on polybutadiene, styrene and alkylacrylates or methacrylates on butadiene, styrene and acrylonitrile on ethylene/propylene/diene terpolymers, styrene and acrylonitrile on polyacrylates or polymethacrylates, styrene and acrylonitrile on acrylate/butadiene copolymers, and copolymer blends known as ABS, MBS, and AES polymers.

Polymers derived from α,β-unsaturated acids and derivatives thereof such as polyacrylates and polymethacrylates; polymethyl methacrylates, polyacrylamides and polyacrylonitriles, impact-modified with butyl acrylate. Copolymers of the monomers mentioned in the preceding paragraph with each other or with other unsaturated monomers, for example acrylonitrile/butadiene copolymers, acrylonitrile/alkyl acrylate copolymers, acrylonitrile/alkoxyalkyl acrylate or acrylonitrile/vinyl halide copolymers or acrylonitrile/alkyl methacrylate/butadiene terpolymers.

Polymers derived from unsaturated alcohols and amines or the acyl derivatives or acetals thereof, for example polyvinyl alcohol, polyvinyl acetate, polyvinyl stearate, polyvinyl benzoate, polyvinyl maleate, polyvinyl butyral, polyallyl phthalate or polyallyl melamine; as well as their copolymers with olefins mentioned above.

Homopolymers and copolymers of cyclic ethers such as polyalkylene glycols, polyethylene oxide, polypropylene oxide or copolymers thereof with bisglycidyl ethers. Polyacetals such as polyoxymethylene and those polyoxymethylenes which contain ethylene oxide as a comonomer; polyacetals modified with thermoplastic polyurethanes, acrylates or MBS.

Polyphenylene oxides and sulfides, and mixtures of polyphenylene oxides with styrene polymers or polyamides.

Polyamides and copolyamides derived from diamines and dicarboxylic acids and/or from aminocarboxylic acids or the corresponding lactams, for example polyamide 4, polyamide 6, polyamide 6/6, 6/10, 6/9, 6/12, 4/6, 12/12, polyamide 11, polyamide 12, aromatic polyamides starting from m-xylene diamine and adipic acid; polyamides prepared from hexamethylenediamine and isophthalic or/and terephthalic acid and with or without an elastomer as modifier, for example poly-2,4,4,-trimethylhexamethylene terephthalamide or poly-m-phenylene isophthalamide; and also block copolymers of the aforementioned polyamides with polyolefins, olefin copolymers, ionomers or chemically bonded or grafted elastomers; or with polyethers, e.g. with polyethylene glycol, polypropylene glycol or polytetramethylene glycol; as well as polyamides or copolyamides modified with EPDM or ABS; and polyamides condensed during processing (RIM polyamide systems).

Polyureas, polyimides, polyamide-imides, polyetherimids, polyesterimids, polyhydantoins and polybenzimidazoles.

Polyesters derived from dicarboxylic acids and diols and/or from hydroxycarboxylic acids or the corresponding lactones, for example polyethylene terephthalate, polybutylene terephthalate, poly-1,4-dimethylolcyclohexane terephthalate, polyalkylene naphthalate (PAN) and polyhydroxybenzoates, as well as block copolyether esters derived from hydroxyl-terminated polyethers; and also polyesters modified with polycarbonates or MBS.

Polycarbonates and polyester carbonates.

Polysulfones, polyether sulfones and polyether ketones.

Crosslinked polymers derived from aldehydes on the one hand and phenols, ureas and melamines on the other hand, such as phenol/formaldehyde resins, urea/formaldehyde resins and melamine/formaldehyde resins.

Unsaturated polyester resins derived from copolyesters of saturated and unsaturated dicarboxylic acids with polyhydric alcohols and vinyl compounds as crosslinking agents, and also halogen-containing modifications thereof of low flammability.

Crosslinkable acrylic resins derived from substituted acrylates, for example epoxy acrylates, urethane acrylates or polyester acrylates.

Alkyd resins, polyester resins and acrylate resins crosslinked with melamine resins, urea resins, isocyanates, isocyanurates, polyisocyanates or epoxy resins.

Crosslinked epoxy resins derived from aliphatic, cycloaliphatic, heterocyclic or aromatic glycidyl compounds, e.g. products of diglycidyl ethers of bisphenol A and bisphenol F, which are crosslinked with customary hardeners such as anhydrides or amines, with or without accelerators.

Blends and alloys of the aforementioned polymers (polyblends), for example PP/EPDM, Polyamide/EPDM or ABS, PVC/EVA, PVC/ABS, PVC/MBS, PC/ABS, PC/Polyester, PBTP/ABS, PC/ASA, PC/PBT, PVC/CPE, PVC/acrylates, POM/thermoplastic PUR, PC/thermoplastic PUR, POM/acrylate, POM/MBS, PPO/HIPS, PPO/PA 6.6 and copolymers, PA/HDPE, PA/PP, PA/PPO, PBT/PC/ABS or PBT/PET/PC.

What is important is that the selected polymer have sufficient tensile strength to be capable of lifting the weight of the two cylinders, but not be brittle. The durometer of the polymer is of a sufficient value so as to permit the mating male/female connectors to remain in their connected position but have sufficient bending capabilities that insertion is possible.

The best mode for carrying out the invention has been described for purposes of illustrating the best mode known to the applicant at the time. The examples are illustrative only and not meant to limit the invention, as measured by the scope and merit of the claims. The invention has been described with reference to preferred and alternate embodiments. Obviously, modifications and alterations will occur to others upon the reading and understanding of the specification. It is intended to include all such modifications and alterations insofar as they come within the scope of the appended claims or the equivalents thereof.

What is claimed is:

1. A handle for spanning two adjacent cylinders, each cylinder having a pair of upwardly-extending collars having at least one aperture extending through a lower part of each collar, the handle further comprising:

a middle segment with a first and a second peripheral arm at opposed ends of the middle segment; wherein the middle segment is an expanded essentially oval or circular section; and the middle segment having a plurality of vertical and upwardly-extending ribs from a longitudinal axis of the middle segment of the handle; and wherein the middle segment is opposed to male and female connector fittings when the connector fittings are fastened together;

the first peripheral arm terminating with the male connector fitting;

the second opposed peripheral arm terminating with the female connector fitting; and the first and second peripheral arms matingly engaging by sliding one-way engagement in a transverse direction to a longitudinal axis of each peripheral arm with each other after insertion of each arm through the at least one aperture in each collar by the male and female connector fittings; and a laterally-extending opening of the female connector fitting having a first end that is larger than an opposite second end such that a width of the laterally-extending opening of the female connector narrows continuously along a length of the laterally-extending opening of the female connector moving from the first end along the length to the second end;

a first male connector fitting laterally-extending ridge having a third end that is larger than an opposite fourth end such that a width of the first male connector fitting laterally-extending ridge narrows continuously along a length of the first male connector fitting laterally extending ridge moving from the third end along the length to the fourth end, the first male connector fitting laterally-extending ridge including a first sidewall at a first side of a base of the male connector fitting and a second sidewall at a second opposite side of the base of the male connector fitting, a second male connector fitting laterally-extending ridge having a fifth end that is larger than an opposite sixth end such that a width of the second male connector fitting laterally-extending ridge narrows continuously along a length of the second male connector fitting laterally extending ridge moving from the fifth end along the length to the sixth end, the second male connector fitting laterally-extending ridge including a third sidewall at the first side of the base of the male connector fitting and a fourth sidewall at the second opposite side of the base of the male connector fitting such that the first sidewall extends parallel to the third sidewall along the length at the first side of the base and the second sidewall extends parallel to the fourth sidewall along the length at the second side of the base; and mating insertion of the first male connector fitting laterally-extending ridge is effected by one-way lateral insertion of the fourth end of the first male connector fitting laterally-extending ridge into the larger first end of the laterally-extending opening of the female connector.

2. The handle of claim 1 wherein the first male connector fitting laterally-extending ridge is at least one raised laterally-extending ridge;

the laterally-extending opening of the female connector fitting is for mating insertion of the first male connector fitting laterally-extending ridge; and wherein mating engagement is by lateral engagement of the male and female connector fittings.

3. The handle of claim 2 wherein the female connector fitting is at least two laterally-extending openings for mating insertion of at least the first and second male fitting laterally-extending ridges.

* * * * *